US005222420A

United States Patent [19]

Sorensen et al.

[11] Patent Number: 5,222,420

[45] Date of Patent: Jun. 29, 1993

[54] QUICK ACTION BAR CLAMP

[75] Inventors: Joseph A. Sorensen; Dwight L. Gatzemeyer, both of Lincoln, Nebr.

[73] Assignee: Petersen Manufacturing Co., Inc., DeWitt, Nebr.

[21] Appl. No.: 687,823

[22] Filed: Apr. 19, 1991

Related U.S. Application Data

[60] Continuation-in-part of Ser. No. 450,837, Dec. 14, 1989, Pat. No. 5,022,137, which is a division of Ser. No. 234,173, Aug. 19, 1988, Pat. No. 4,926,722.

[51] Int. Cl.[5] ..... B25B 5/02; B25B 13/12

[52] U.S. Cl. ..... 81/487; 81/152; 269/6; 269/169

[58] Field of Search ..... 81/152, 150, 487, 126; 269/6, 166–170, 900

[56] References Cited

U.S. PATENT DOCUMENTS

| | | | |
|---|---|---|---|
| 2,452,849 | 11/1948 | Gross | 81/143 |
| 2,574,227 | 11/1951 | Sarvie | 81/152 |
| 3,096,975 | 7/1963 | Irwin | 269/169 |
| 4,874,155 | 10/1989 | Goul | 269/6 |
| 4,926,722 | 5/1990 | Sorensen et al. | 81/487 |
| 4,989,847 | 2/1991 | Chapman | 269/170 |
| 5,005,449 | 4/1991 | Sorensen et al. | 81/487 |
| 5,009,134 | 4/1991 | Sorensen et al. | 81/487 |
| 5,094,131 | 3/1992 | Sorensen et al. | 81/487 |

FOREIGN PATENT DOCUMENTS 2178689 2/1987 United Kingdom .

*Primary Examiner*—Roscoe V. Parker

[57] ABSTRACT

A hand tool consists of a movable jaw, a slide bar wherein the movable jaw is mounted to the slide bar. A support assembly is provided for supporting the slide bar. A stationary jaw is spaced away from the support assembly and is provided with at least a front portion. A one-way drive arrangement is designed having at least a driving lever. A cam having a longitudinally extending handle is pivotally mounted at the support assembly and contacts the driving lever. The cam disengages the driving lever when the one-way drive arrangement is released from the slide bar, and the cam engages the driving lever when the one-way drive arrangement engages the slide bar.

12 Claims, 8 Drawing Sheets

FIG. 5
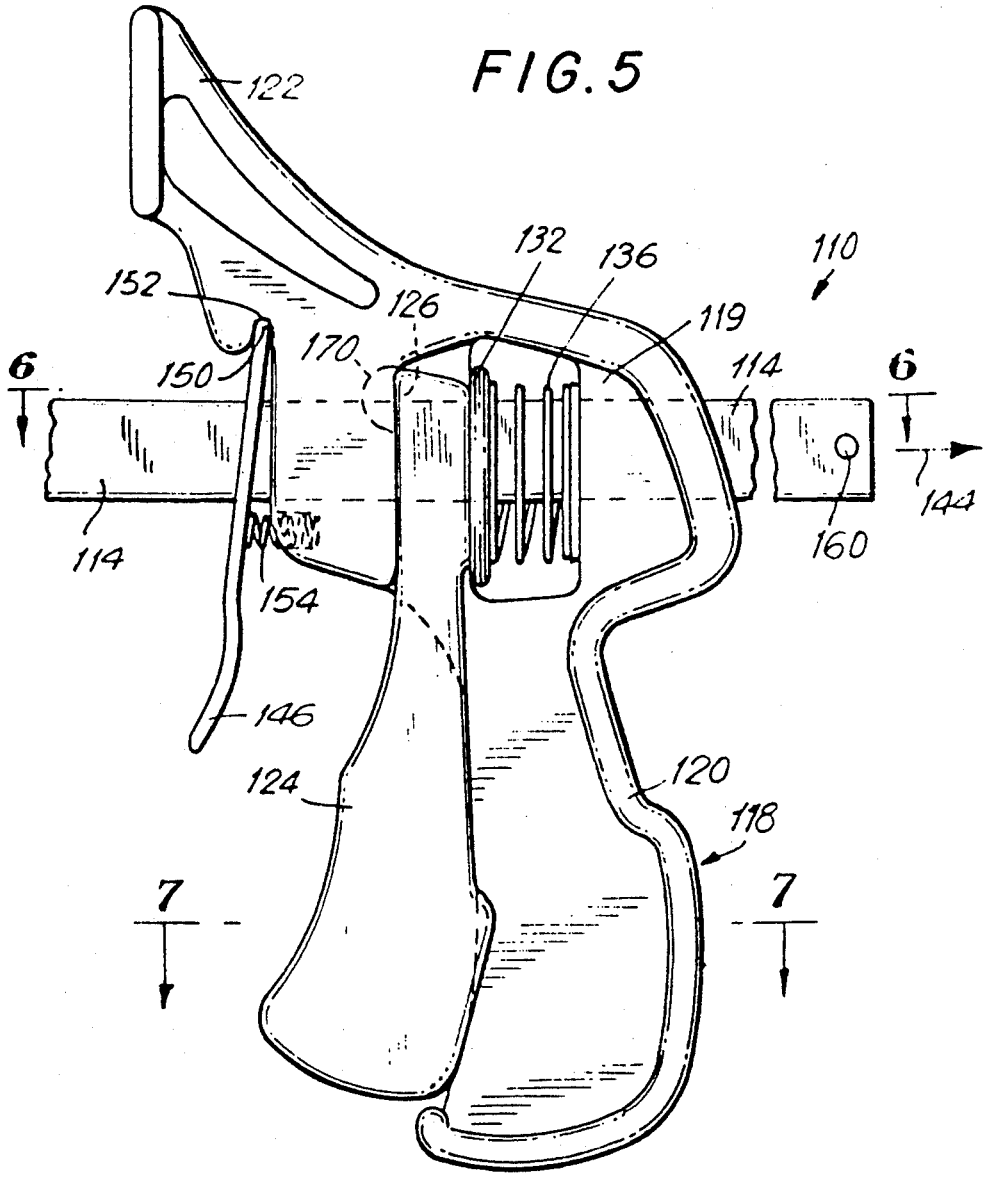
FIG. 6
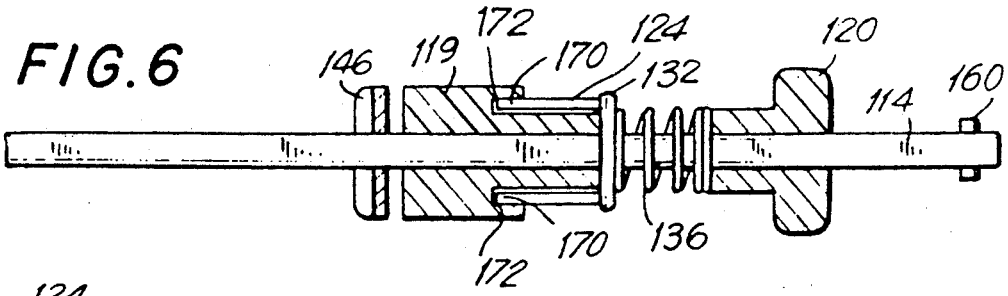
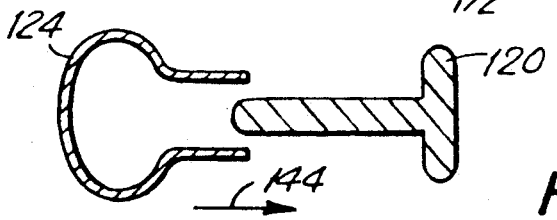
FIG. 7

QUICK ACTION BAR CLAMP

This application is a continuation-in-part application of U.S. patent application Ser. No. 450,837, filed on Dec. 14, 1989 now U.S. Pat. No. 5,022,137 which is a divisional application of U.S. patent application Ser. No. 07/234,173, filed on Aug. 19, 1988 now U.S. Pat. No. 4,926,722.

BACKGROUND OF THE INVENTION

This invention relates generally to a bar clamp of the type used to temporarily clamp together two articles, for example, for gluing, or to hold a workpiece for welding, and more particularly to a quick-action bar clamp wherein the moving jaw can be rapidly advanced or advances in small increments of selectable length. The concept of a bar clamp is old and well-known. In recent years, over-center toggle action handgrips have been incorporated for use in final tightening against the workpiece, for example, in U.S. Pat. No. 4,088,313 by Pearson and U.S. Pat. No. 4,563,921 by Wallace. A disadvantage in the prior art lies in the fact that adjustment in the moving jaw over a substantial distance is cumbersome and imprecise. Frequently, the moving jaw is entirely disengaged and free to move until the final tightening of an object between the movable and fixed jaws is accomplished. A third hand would be helpful.

What is needed is a bar clamp having a moving jaw which is rapidly movable over both short and long distances to clamp against a workpiece and is operable using one hand with complete control by the operator at all times.

SUMMARY OF THE INVENTION

In accordance with the invention, a bar clamp suitable for rapid and precise closure against a workpiece is provided, the clamp includes a movable jaw, a slide bar in which the movable jaw is mounted to the slide bar. A support assembly is provided for supporting the slide bar. A stationary jaw is spaced away from the support assembly and is provided with at least a front portion. A one-way drive means is designed having at least a driving lever. A cam having a longitudinally extending handle is pivotally mounted at the support assembly and contacts the driving lever. The cam disengages the driving lever when the one-way drive arrangement is released from the slide bar, and the cam engages the driving lever when the one-way drive arrangement engages the slide bar.

According to another embodiment of the invention, a hand tool is provided with receiving means situated in the support means. A release tab pivotable at the receiving means and having an engaging portion adjacent to the slide bar extends outwardly from the support means and away from the handle for releasably engaging the slide bar. A rotary motion of the cam means causes the driving lever to pivot about its one end. The rotary motion of the cam means places the driving lever at an angle to the slide bar preventing the slide bar and the movable jaw from moving away from the stationary jaw.

In a further embodiment of the invention, the engaging portion consists of a cam-shaped portion and an elongated finger, wherein said cam-shaped portion and the elongated finger are separated by recess means.

BRIEF DESCRIPTION OF THE DRAWINGS

For a fuller understanding of the invention, reference is had to the following description taken in connection with the accompanying drawings, in which:

FIG. 5 is a view similar to FIG. 1 of an alternative embodiment of a quick-action bar clamp in accordance with the invention;

FIG. 6 is a sectional view taken along the line 6—6 of FIG. 5;

FIG. 7 is a sectional view taken along the line 7—7 of FIG. 5;

DESCRIPTION OF THE PREFERRED EMBODIMENTS

Figure 1:
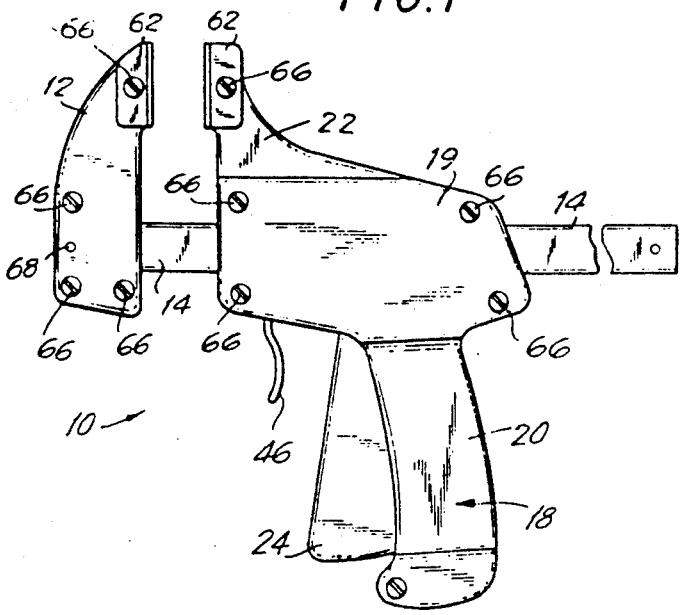
FIG. 1 is a front view of a quick-action bar clamp in accordance with the invention.

Although a specific embodiment of the invention will now be described with reference to the drawings, it should be understood that the embodiment shown is by way of example only and merely illustrative of but one of the many possible specific embodiments which can represent applications of the principles of the invention. Various changes and modifications, obvious to one skilled in the art to which the invention pertains, are deemed to be within the spirit, scope and contemplation of the invention as further defined in the appended claims.

With reference to FIGS. 1–7, a quick-acting bar clamp 10 includes a movable jaw 12 connected to a slide bar 14. The slide bar is slidably supported in a slot 16 (FIG. 4) which passes through a handle/grip assembly 18.

The handle/grip assembly 18 includes a body 19 through which the slot passes, a handgrip 20 attached to the body 19 on one side of the slot 16, and a fixed jaw 22 attached to the body 19 on one side of the slot 16. A trigger handle 24 is pivotably mounted to the body 19 adjacent the slot 16 by means of a pivot pin 26. The moving jaw 12 opposes the fixed jaw 22.

Figure 4:
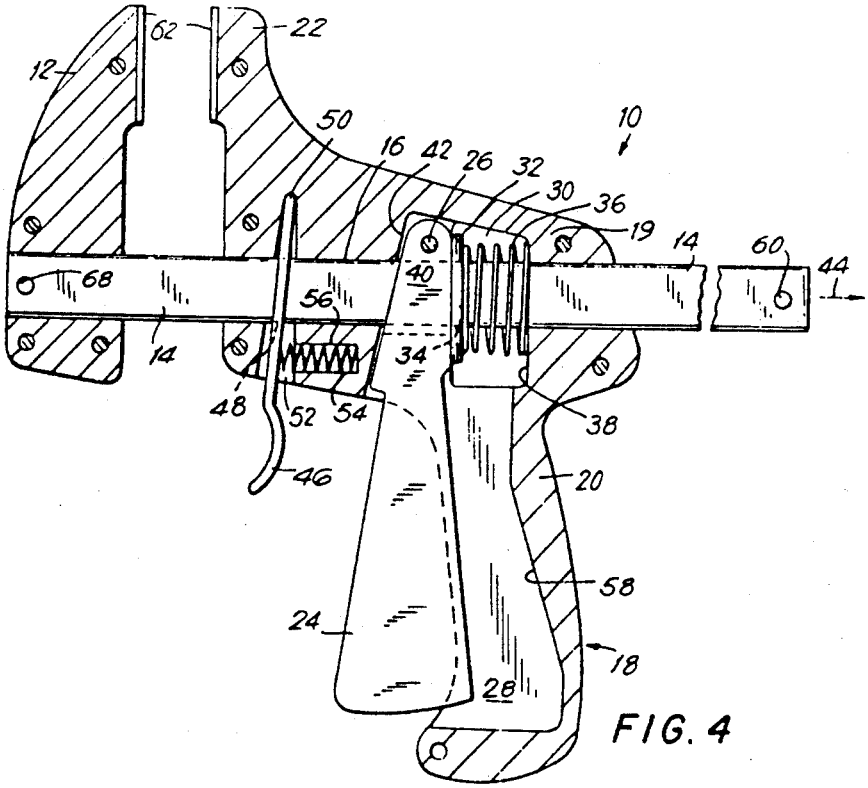
FIG. 4 is a sectional view to an enlarged scale taken along the line 4—4 of FIG. 3.

As best illustrated in FIG. 4, the handle grip 20 is hollow in part so as to receive the trigger handle in the cavity 28. A second cavity 30 in the body 19 divides the bore 16. A driving lever 32 is suspended on the slide bar 14 which passes through a hole 34 in the driving lever 32. A spring 36 is compressed between the driving lever 32 and a surface 38 of the cavity 30 urging the driving lever 32 against the upper end 40 of the trigger handle 24. The upper end 40 of the trigger handle 24 is forked and straddles the slide bar 14. Force of the spring 36 urges the trigger handle 24 against an inner surface 42 of the body 19 thus providing a standby condition. In the standby condition, the driving lever 32 is positioned perpendicular to the direction of motion, indicated by the arrow 44, of the slide bar 14 when in operation. Any motion of the trigger handle 24 about the pivot pin 26 in the direction of the arrow 44 is accomplished against the bias of the spring 36.

A braking lever 46 is suspended from the slide bar 14 which passes through an opening 48 in the braking lever 46. One end 50 of the braking lever 46 is pivotably captured in a recess 52 within the body 19 such that the braking lever 46 may pivot within constraints defined by the surfaces of the recess 52 and by binding of the braking lever 46 with the slide bar 14 when the edges of the opening 48 in the lever 46 engage the surface of the slide rod 14. A spring 54 seats in a recess 56 in the body 19 and biases the free end of the braking lever 46 away from the trigger handle 24. The biased position of the braking lever 46 is limited by the binding interference between the opening 48 of the lever 46 with the slide bar 14.

It should be noted that in the standby position illustrated in FIG. 4, the driving lever 32 is substantially perpendicular to the longitudinal axis of the slide bar 14, whereas the portion of the braking lever 46 which engages the slide bar 14 is transverse to the longitudinal axis of the bar 14 but not perpendicular thereto. In this condition, if a force is applied to the moving jaw 12 in the direction indicated by the arrow 44, the slide bar 14 is free to move through the hole 34 in the driving lever 32 and through the spring 36. Because the braking lever 46 is free to pivot against the bias of the spring 54 when force is applied on the moving jaw 12 in the direction of the arrow 44, the braking lever 46 presents no obstacle to this motion of the slide bar and the moving jaw 12 may be advanced continuously toward the fixed jaw 22.

However, in the standby position as illustrated in FIG. 4, if a force is applied to the movable jaw 12 in the direction opposite to the direction opposite to the direction indicated by the arrow 44, the edges of the opening 48 in the lever 46 bind against the surface of the slide bar 14 and it is not possible, without further action, to withdraw the moving jaw farther away from the fixed jaw 22, as described more fully hereinafter. Compression of the spring 56 by pressing on the braking lever 46 in the direction of the arrow 44, allows withdrawal of the slide bar 14 and movable jaw 12 away from the fixed jaw 22. This force brings the end 50 of the lever 46 into perpendicularity with the direction of intended motion of the slide bar 14. Then the slide bar 14 is free to slide in either direction through the opening 48 in the braking lever 46.

The trigger handle 24 is squeezed in the direction indicated by the arrow 44 to incrementally advance the slide bar 14 with its attached movable jaw 12 toward the fixed jaw 22. When the handle 24 is squeezed between a user's hand (not shown) and the handgrip 20, pivoting occurs about the pivot pin 26 and the end 40 of the trigger handle 24 moves in the direction of the arrow 44. This causes the driving lever 32 to pivot about its upper end (FIG. 4), so that the driving lever 32 is no longer perpendicular to the direction 44 of intended motion of the slide bar 14. Pivoting the driving lever 32 compresses the spring 36 and also causes the edges of the hole 34 through the driving lever 32 to bind against the surface of the slide bar 14. Binding occurs because the driving lever 32 is no longer perpendicular to the direction 44 of intended motion of the slide bar 14. Further motion of the trigger handle 24 causes the driving lever 32 to translate in the direction of the arrow 44. This motion further compresses the spring 36 and in the process, by means of the binding interference between the lever 32 and bar 14, advances the bar 14 and its connected movable jaw 12 toward the fixed jaw 22. The maximum distance of advance of the movable jaw 12 with one stroke of the trigger handle 22 is limited when the spring 36 is fully compressed or, in an alternative construction, the handle 24 strikes the inner surface 58 of the handgrip 20.

However, the stroke of the trigger handle 24 can be through any lesser arc, thereby diminishing the distance the movable jaw 12 travels in a single stroke in proportion to the angle of the trigger handle stroke. Additional strokes may be applied to the trigger handle 42 of any magnitude until the jaws 12, 22 come together, or a workpiece (not shown) is firmly gripped between them.

After the trigger handle 24 is fully pivoted in the direction of the arrow 44 about the pivot pin 26, release of the trigger handle 24 causes the return of the trigger handle 24, driving lever 32 and spring 36 to the position shown in FIG. 4 as a result of the compressive forces in the spring 36 urging the components toward the movable jaw 12.

A transverse pin 60 passing through the free end of the slide bar 14 prevents withdrawal of the slide bar 14 from the slot 16 when the braking lever 46 is pressed in the direction of the arrow 44 and the movable jaw 12 is manually drawn away from the fixed jaw 22. It should be noted that operation of the trigger handle 24 is ineffective in accomplishing any motion of the slide bar 14 in the direction opposite to the arrow 44.

For illustrative purposes only, protective pads 62 are shown attached to the jaws 12, 22. Also for illustrative purposes, the moving jaw 12 and the handle/grip assembly 18 are formed of halves which are held together by screws 66. The moving jaw 12 is held to the slide bar 14 by a pin 68. In the illustrated embodiment (FIG. 4) in accordance with the invention, the slide bar 14 has a rectangular cross-section. In alternative embodiments in accordance with the invention, the slide bar 14 may be any shape, for examples, square, round, triangular, and the openings 34, 48 in the levers 32, 46, respectively, are appropriately shaped for proper binding interference with the slide bar 14.

In summary, if it is considered that a workpiece is to be clamped between the jaws 12, 22, the movable jaw 12 can be advanced toward the fixed jaw 26 either in one continuous motion, merely by pushing in the direction of the arrow 44 on the movable jaw 22 or, by operating the trigger handle 24 in a series of strokes of length to be determined by the user. Large strokes may be used a first and small strokes later as the desired pressure is applied to the workpiece. During this advancing operation, the braking lever 46 prevents any backward motion of the slide bar 14 after each advance has been completed. While the braking lever 46 hold the bar 14, the trigger handle 24 is released. The spring 36 then returns the handle 24 and driving lever 32 to the positions shown in FIG. 4, ready for another stroke. At any time when the user desires to retract the movable jaw 12 away from the fixed jaw 22, for example, to release a workpiece or to open the bar clamp to receive a workpiece, it is only necessary to pull on the movable jaw 12 in the direction opposite to the arrow 44 while simultaneously compressing the spring 54 by pressing on the braking lever 46 in the direction of the arrow 44.

It should be noted that all operations of the trigger handle 24 and braking lever 46 can be accomplished with the same hand while holding the bar clamp 10 with that hand. Either the index or middle finger is in position to actuate the braking lever 46 as required while the other fingers encircle and contain the trigger handle 24 and handgrip 20.

Figure 2:
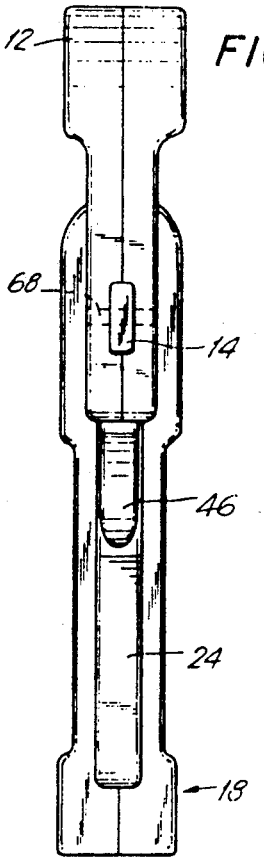
FIG. 2 is a left end view to an enlarged scale of the quick-action bar clamp of FIG. 1.
Figure 3:
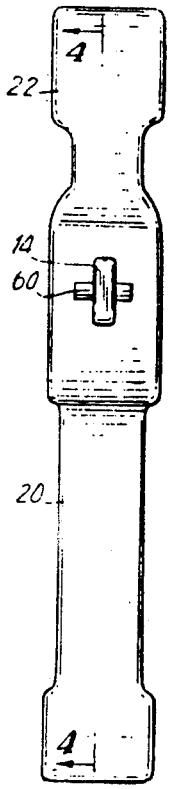
FIG. 3 is a right end view to an enlarged scale of the quick-action bar clamp of FIG. 1.

As best illustrated in FIGS. 2 and 3, the overall quick-actin bar clamp 10 in accordance with the invention is basically flat, takes little space, and can be operated in tight places. Slide bars 14 of difference lengths may be used.

In FIGS. 1–4, the handle/grip assembly 18 is formed of halves which are held together by screws 66 and the trigger handle 24 is solid and slips into the cavity 28 in the handgrip 20. In alternative embodiment (FIGS. 5–7), a quick-action bar clamp 110 in accordance with the invention includes a one-piece handle/grip assembly 118, which includes no internal recess, and a basically U-shaped trigger handle 124. When the trigger handle 124 is squeezed against the handgrip 120, as will be apparent in FIG. 7, the handle 124 moves in the direction of the arrow 144 and straddles the handgrip 120. The end 150 of the braking lever 146 pivots in a recess 152 in the handle/grip assembly body 119. The trigger handle 124 pivots about an axis 126 and includes semicircular tabs 170 which are recessed into correspondingly shaped slots 172 in the body 119.

Operation of the bar clamp of FIGS. 5–7 is the same as that for the embodiment of FIGS. 1–4, taking note that the reference numerals in FIGS. 5–7 correspond with those numerals used in describing FIGS. 1–4, with addition of 100 thereto.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings, shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

Figure 8:
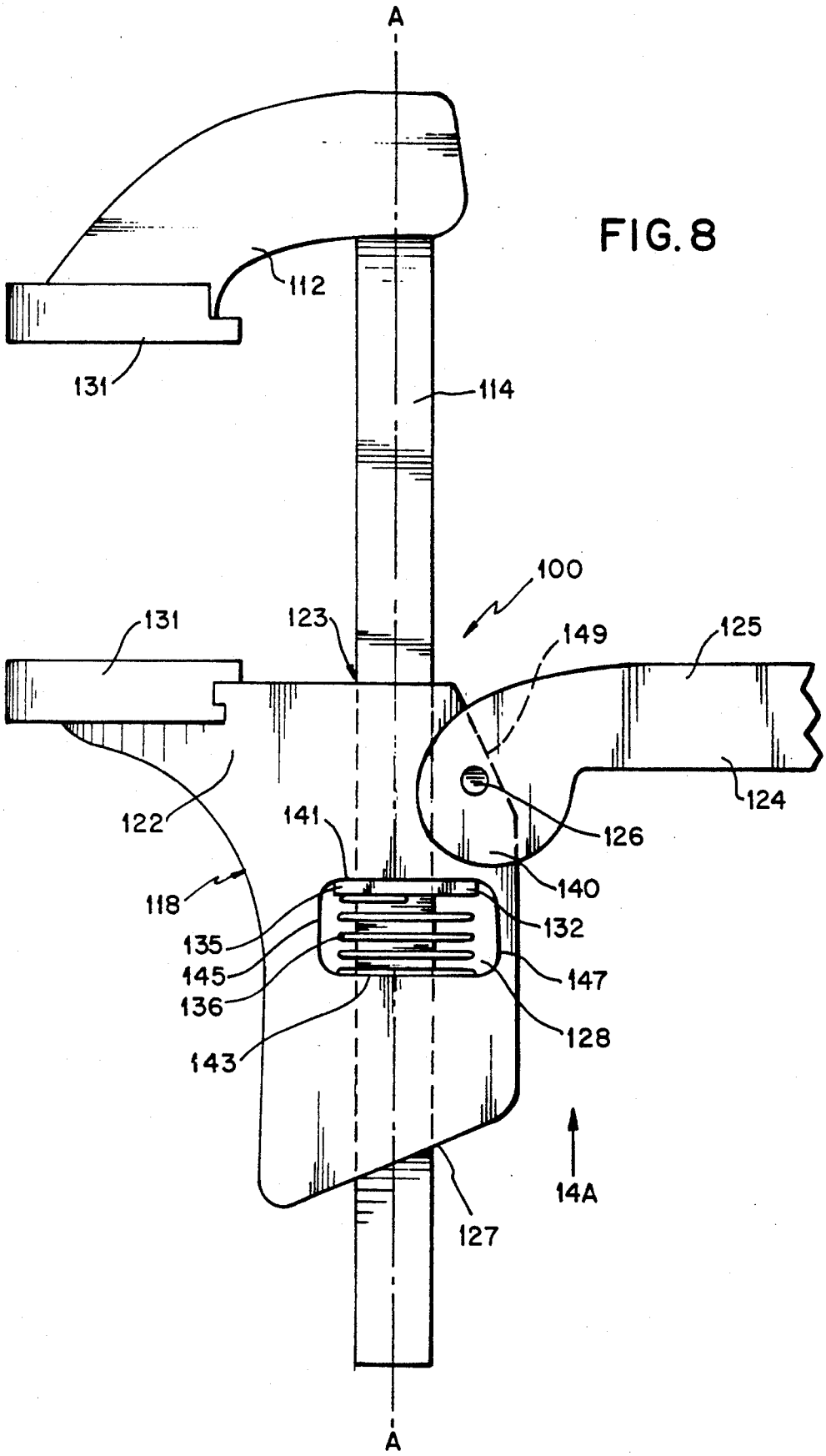
FIG. 8 is a front elevational view of a cam clamp in its open position.
Figure 9:
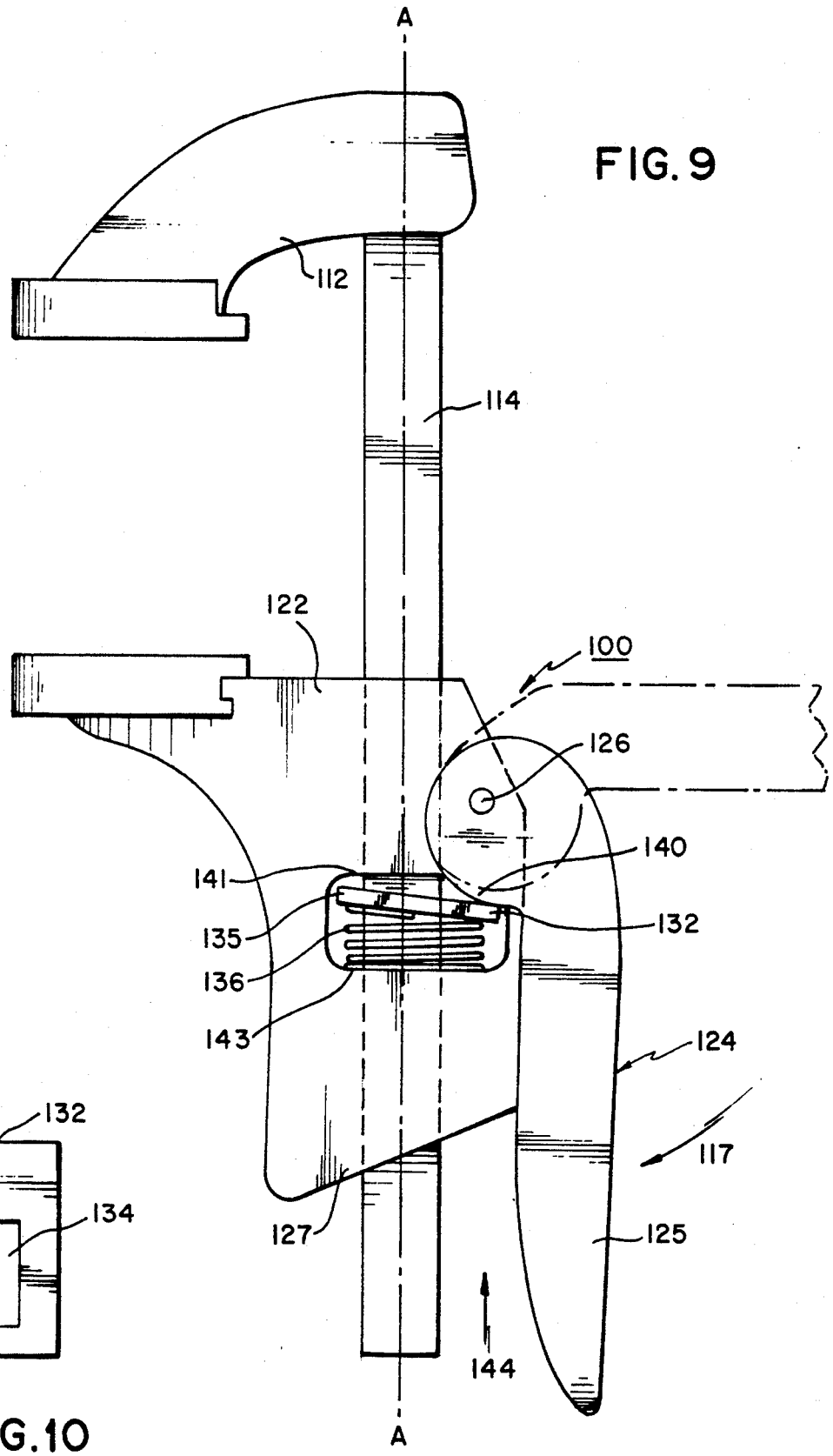
FIG. 9 is a side elevational view of the cam clamp with its handle in its closed condition.
Figure 10:
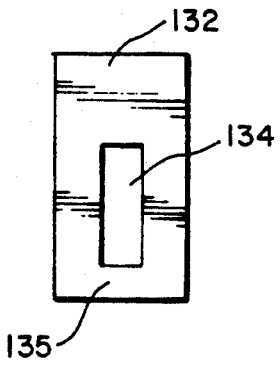
FIG. 10 is a front view of the driving lever.

Referring now to FIGS. 8–10, an improved version of the invention is shown at 100 and includes a movable jaw 112 mounted to a slide bar 114. The slide bar 114 is movable within openings 123 and 127 of a support assembly or support means 118.

Jaws 112 and 122 can be provided with slightly compressible, resilient and removable pads 131 suitably made from conventional materials.

A longitudinally extending clamping handle assembly 124 is pivotably mounted to the support assembly 118 by means of a pivot pin or connection 126. For illustrative purposes this pivotal connection is illustrated to be positioned in the vicinity of a cavity 128 of the support assembly. The clamping handle assembly 124 typically consists of an elongated handle 125 and a cam-shaped portion 140 positioned at one of its ends.

As a result of pivotal motion of clamping handle assembly 124 from the open position shown in FIG. 8 to the closed position illustrated in FIG. 9, at least a part of the cam-shaped portion 140 extends into the cavity 128 of the support assembly 118. The cavity 128 is limited by a front portion 141, rear portion 143 and two side portions 145 and 147. In FIG. 8, longitudinally extending clamping handle 124 is in its open position and extends transversely to the longitudinal axis A—A of slide bar 114. In such condition a driving lever 132 is released from slide bar 114.

The driving lever 132 is located and/or suspended on the slide bar 114 which passes through a hole 134 (see FIG. 10) in the driving lever 132. A compression spring 136 situated between the driving lever and the rear portion 143 of the cavity 128 urges the driving lever 132 against the cam-shaped portion 140 of the clamping handle assembly 124. At least the cam-shaped end 140 of the clamping handle 124 is designed in the form of a fork so as to straddle at least a rib portion 149 of the body 118. Force of the spring 136 presses against driving lever 132 which in turn presses against cam-shaped surface 140, thus providing a standby condition with the driving lever 132 released from slide bar 114 and clamping handle 124 substantially transverse to slide bar 114. In the standby or open condition of FIG. 8, the driving lever 132 is positioned substantially perpendicular to the direction of motion, indicated by the arrow 144. Motion of the clamping handle 124 about the pivot 126 in the direction of an arrow 117 to the closed position of FIG. 9 is adapted to move the driving lever against the bias of the spring 136 as hereinafter described. Such motion also locks the slide bar from its advancement in the direction opposite to that identified by the arrow 144.

In the open or standby position illustrated in FIG. 8 and described above, the driving lever 132 is substantially transverse to the longitudinal axis A—A of the slide bar 114 and driving lever 132 is released from slide bar 114. In this condition, if a force is applied to the movable jaw 112 in the direction indicated by the arrow 144 (and also in the opposite direction), the slide bar 114 is free to move through the openings of the support assembly 118 so that the movable jaw 112 and the fixed jaw 122 can advance toward and/or away from each other.

Applying a predetermined force at a free end of the handle, a resulting moment arm force with respect to the pivot point 126 is developed. Therefore, generally speaking, the actual force applied by the cam portion 140 acting on the driving lever 132 substantially equals the predetermined force applied by the user to the end of the handle multiplied by the distance from the pivot point 126 to the free end of the handle 125 (disregarding the insignificant change in distance from the cam surface to the driving lever). Obviously, the moment arm force acting on the driving lever 132 will be greater with a longer handle.

In rotating clamping handle 124 to the closed, or clamped position as illustrated in FIG. 9, the movement of cam-shaped portion 140 of clamping handle 124 causes driving lever 132 to pivot about its end 135 and lever 132 is no longer perpendicular to slide rod 114 and binds against the end edges of slide rod 114. In such condition, if a force is applied to the movable jaw 112 in the direction of the arrow 144, the end edges of the opening 134 in the driving lever 132 bind against the end surfaces of the slide bar 114 and it is not possible to withdraw the movable jaw 112 further away from the stationary jaw 122 and a workpiece (not shown) is securely held in place. However, in the condition illustrated in FIG. 9, if the force is applied to the slide bar in the direction opposite to the arrow 144, then the slide bar and the movable jaw 112 are free to move in the direction of the stationary jaw 122.

When the clamping handle 124 is rotated as above-described, pivoting thereof occurs about the pivot pin 126 which causes the driving lever 132 to pivot about its first end 135, so that the driving lever 132 is no longer perpendicular to the direction 144 of intended motion of the slide bar 114. The rotational/pivoting motion of the eccentric/cam portion 140 is transferred into the pivoting motion of the driving lever 133. Pivoting of the driving lever 132 as described compresses the spring 136 and also causes the end edges of the hole 134 through the driving lever 132 to bind against the end surfaces of the slide rod 114. Binding occurs because the driving lever 132 is no longer perpendicular to the longitudinal axis A—A of the slide bar 114 as previously described.

After the clamping handle 124 is fully pivoted in the direction of the arrow 117 about the pivot pin 126 to the position of FIG. 9, release of the clamping handle 124 by rotation opposite to the direction 117 causes the return of the clamping handle 124, driving lever 132 and spring 136 to the open position shown in FIG. 8.

In operation of the hand tool illustrated in FIGS. 8–10, initially the handle assembly 124 is placed in the open position in which the driving lever is positioned substantially transverse to the slide bar. The jaws 112 and 122 are moved away from each other to allow placement of workpiece or workpieces therebetween. Then, the jaws 112 and 122 are moved manually in the direction of each other, so that the pads 131 of each jaw engage the workpiece and exert pressure thereupon. In this condition, the clamping handle 124 is rotated in the direction of the arrow 117. The rotary motion of the cam-shaped portion 140 causes the driving lever 132 to pivot about its end 135, placing the lever 132 at an angle to the slide bar and preventing the slide bar 114 and the movable jaw 112 from motion in the direction of the arrow 144. This secures engagement between the jaws 112, 122 and the workpiece.

In order to enable the slide bar 114 to advance incrementally during movement of the handle from the open to the closed position, it is necessary to prevent the slide bar and the movable jaw 112 from moving away from the support assembly 118 and the fixed jaw 122. It is especially important to prevent such motion during the initial rotation of the handle 124 about the pivot point 126, while the driving lever 132 remains substantially transverse to the slide bar 114 and the opening 134 of the driving lever does not fully engage the slide bar.

Figures 11, 12:
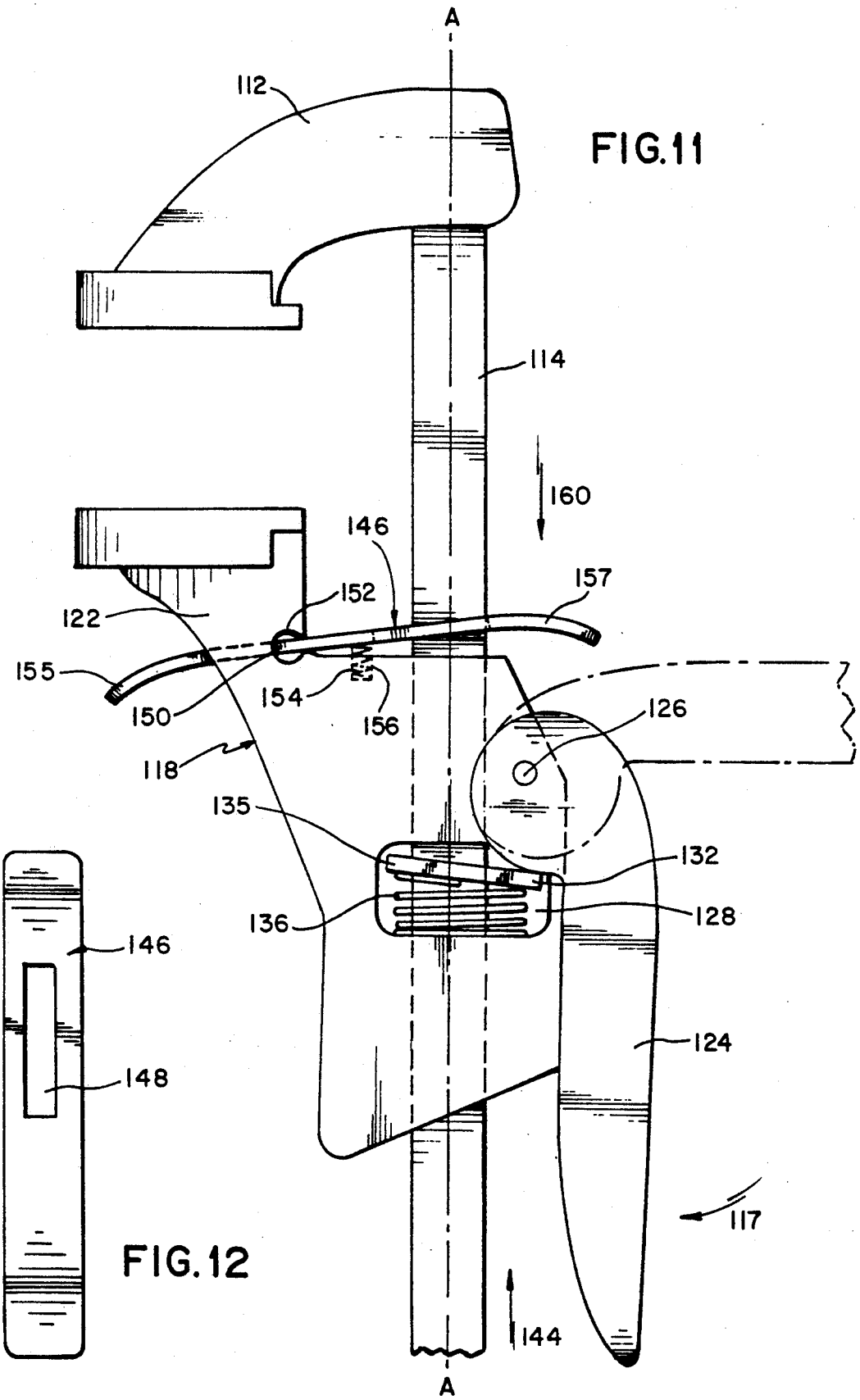
FIG. 11 is another embodiment of the cam clamp.
FIG. 12 is a front elevational view of the release tab.

In the embodiment of the invention illustrated in FIGS. 11 and 12, such motion of the slide bar away from the support assembly is prevented by an action of the release tab 146. Therefore, the rotation of the clamping handle 124 in the direction indicated by the arrow 117 (toward the slide bar 114), advances the slide bar toward the stationary jaw 122. Thus, the bar 114 along with the movable jaw 112 will advance in an incremental step for each stroke or movement of the handle 124 from the open position to the closed position.

In FIG. 11 the release tab 146 is shown at a front portion of the support assembly. In operation, the slide bar 114 passes through an opening 148 in the release tab 146. A portion of the release tab is pivotally positioned within a recess 152, so that the release tab may pivot within constraints defined by the surfaces of the recess and by binding the release tab with the slide bar 114 when the edges of the opening 148 of the release tab engage the surfaces of the slide bar. It is best illustrated in FIG. 11 that the recess 152 is situated in the vicinity of the junction between the front portion of the support assembly 118 and the fixed jaw 122. At least one compression spring 154 is situated in an elongated recess 156 in the body 118 of the support assembly. Such spring biases at least one free end of the release tab away from the front portion of the support assembly. The biased position of the release tab is limited by the binding interference between the opening 148 in the release tab and the outside surfaces of the slide bar 114.

The release tab can extend in one direction of the handgrip from the recess 152 so its first end or engaging portion 157 is remote from the recess 152 and can be suitably gripped by a finger of a user.

Alternatively, the release tab 146 may also extend from the recess 152 in both directions, so that the second free end 155 may pass through the body of the support assembly and protrude outwardly defining an engaging surface for activation by fingers of the user.

In the closed clamping position of FIG. 11, the slide bar 114 passes freely in the direction opposite to that of the arrow 144 through an opening 148 in the release tab 146. However, it cannot move in the direction of the arrow 144 due to binding of at least the release tab 146 in the slide bar 114. In the closed position of the present invention illustrated in FIG. 11, the driving lever 132 is at a slight angle to the longitudinal axis A—A of the slide bar. Therefore, a force applied in the direction opposite to that of the arrow 144 will advance the slide bar 114. However, when a force is applied to the slide bar in the direction of the arrow 144, the end edges of the opening 134 in the driving lever 132 bind against the end surfaces of the slide bar 114 and restrain movement thereof as hereinabove discussed. In the open position of the clamping handle 124 (shown in dotted lines in FIG. 11), the release tab 146 engages the slide bar 114 in the slightly angled position, but when moved by finger pressure in the direction of an arrow 160, against the biased spring 154, the opening 148 of release tab 146 disengages from the end surfaces of slide bar 114 and the slide bar 114 can be moved toward and away from the stationary jaw 122. Removing pressure from release tab 146 causes the tab 146 to be returned by the compressed spring 154 to its initially slightly angled position to bind against the surfaces of the slide bar 114.

Figure 13:
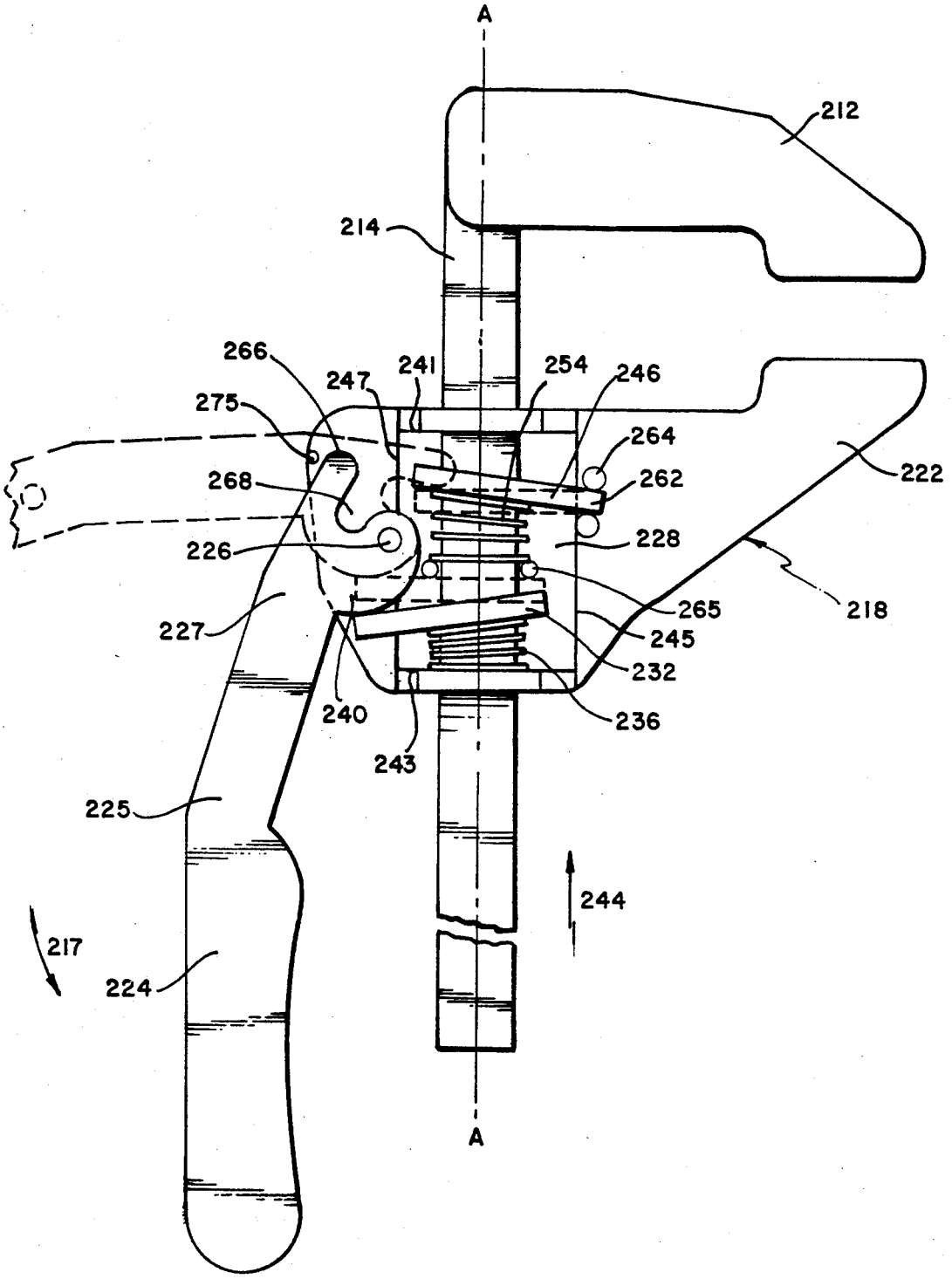
FIG. 13 is a further embodiment of the cam clamp hand tool.

A further embodiment of the present invention is shown in FIG. 13. The support assembly 218 is provided with a cavity 228 which is limited by a front portion 241, a rear portion 243 and two side portions 245 and 247. A Driving lever 232 suspended on the slide bar 214 is situated within the cavity 218. A first compression spring 236 is positioned between the driving lever and the rear portion 243 of the cavity. A release tab 246 is also situated within the cavity 228. The slide bar 214 passes through openings in the release tab 246 and the driving lever 236. One end 262 of the release tab 246 is pivotally mounted within an opening 264 situated at the sidewall 245 of the cavity 228. The release tab pivots within the constraints of the opening 264 and is guided by the dimensions of the slide bar and the opening in the release tab A second compression spring 254 is positioned between the release tab 246 and the stop member 265 and urges the release tab upwardly in the direction of the movable jaw 212.

A clamping handle unit 224 is pivotably mounted to the support assembly 218 by means of a pivot connection 226. The handle unit 224 includes an elongated handle 225 and engaging portion 227. The engaging portion consists of a cam-shaped portion 240 and an elongated finger 266 which are separated by a recess 268.

In the closed or clamping position of the hand tool illustrated in FIG. 13, similar to the above discussed embodiment, the slide bar 214 may pass in the direction opposite to that of the arrow 244 through the opening in the release tab 246. In this condition, the slide bar 214 cannot move in the direction of the arrow 244 in view of at least binding of the release tab 246 in the slide bar 214. In the closed position of the hand tool, the driving lever 232 is at an angle to the longitudinal axis A—A of the slide bar.

A force applied to the handle 244, positioned substantially transversely to the slide bar 214, in the direction of the arrow 217 advances the slide bar in the direction opposite to the direction of the arrow 244. Such motion is accomplished by the engagement between the cam portion 240 and the driving lever 232. In this condition, the release tab 246 positioned at a slight angle to the longitudinal axis A—A of the slide bar prevents motion of the slide bar in the direction according to the arrow 244.

The slide bar 214 with the movable jaw 212 will advance in an incremental step for each movement of the handle from a slightly open to the closed position.

However, if the handle is moved in the direction opposite to the arrow 217 to a position (illustrated in dotted lines in FIG. 13) the finger portion 266 engages the release tab 246 and presses it against the spring 254. In this condition, the release tab 246 and the driving lever 236 are positioned substantially transverse or perpendicular to the longitudinal axis A—A of the slide bar. Therefore, the driving lever and the release tab do not substantially engage the slide bar 214 which is free to move within the support assembly 218.

During operation of the hand tool shown in FIG. 13, when the handle is raised to the open position (illustrated by the dotted lines) the slide bar can freely move within the support assembly 218 in either direction. In this condition, the driving lever 236 and the release tab 246 are positioned substantially perpendicular to the longitudinal axis A—A of the slide bar.

When the handle is raised and lowered consecutively, the engagement of the cam portion 240 with the driving lever 246 will move incrementally the slide bar and the movable jaw within the support unit 218 in the direction of the fixed jaw 222. During the movement of the handle in the direction opposite to the arrow 217, accidental release of the release tab 246 is prevented by the detent means 275 located the front portion of the support assembly. The detent means 275 does not allow the handle to move further in this direction. In this position, the elongated finger 266 is not in a position to contact the release tab 246. The release tab 246 thus binds against the bar and prevents the clamp from accidental opening.

However, further motion of the handle 224 in the direction opposite to the arrow 217 passes the detent and causes the elongated finger 266 to engage the end of the release tab 246. This engagement presses the release tab 246 against the bias of the spring 254 and places the release tab in a condition substantially perpendicular to the slide bar 214, enabling the slide bar to move freely within the support assembly 218.

In the embodiments of FIGS. 8–13, the pivot connection between the clamping handle assembly and the support means is situated between the front portion of the support means facing the movable jaw and the driving lever. In these embodiments the cam portion of the clamping handle assembly engages a surface of the driving lever which faces the front of the support means and the fixed jaw. However, a hand tool having such a pivotal point positioned between the rear end of the support means and the driving lever is within the scope of the present invention. During operation of such alternative embodiment, the cam portion of the clamping handle assembly engages a surface of the driving lever facing the rear end of the support means.

In the embodiments of FIGS. 8–13, the movable jaw and the fixed jaw are positioned on one side of the support means or assembly and face each other. Therefore, during operation of these hand tools, to apply pressure on a workpiece the slide bar with the movable jaw is moved in the direction of the fixed jaw.

Figure 14:
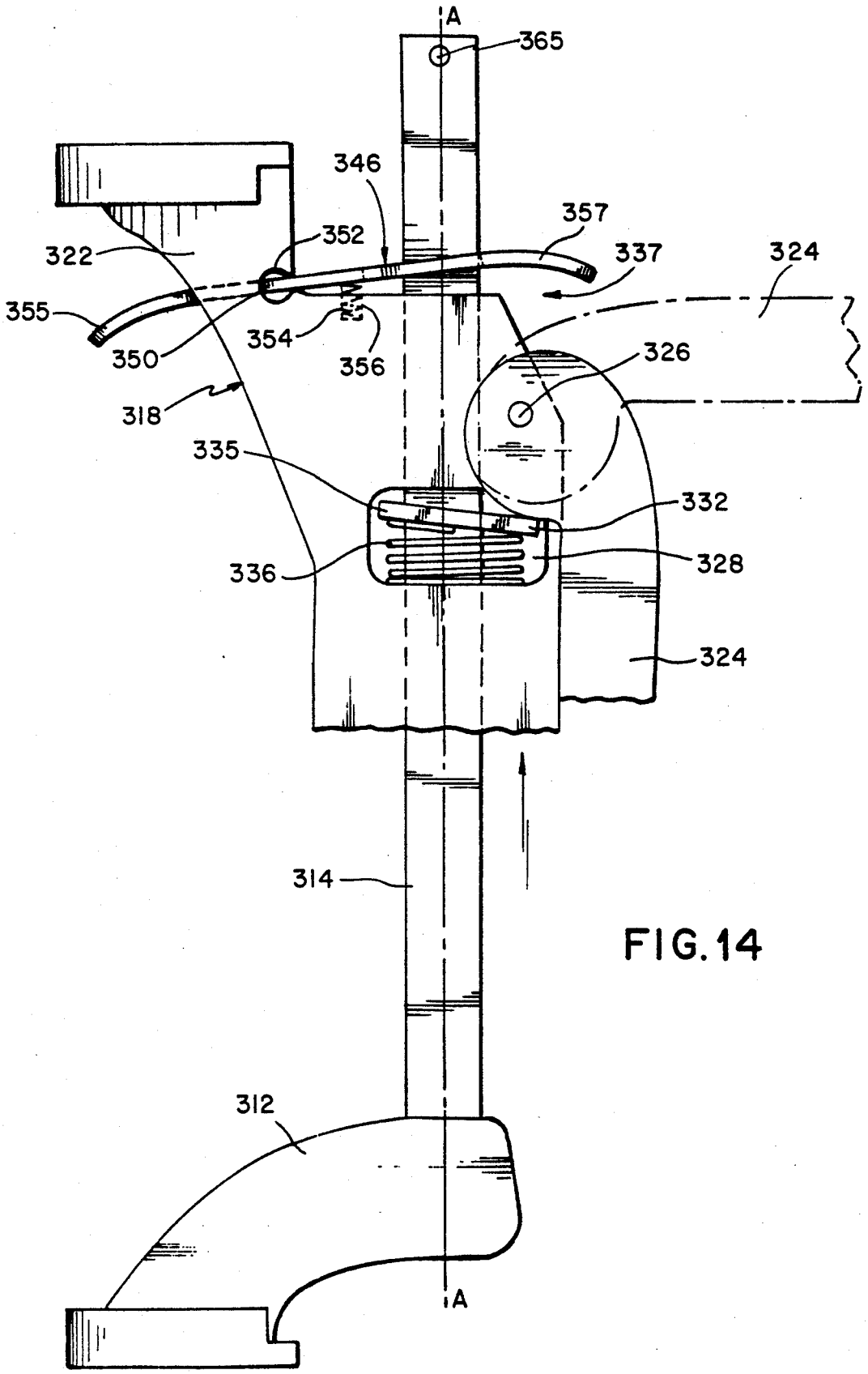
FIG. 14 is a front elevational view of a further embodiment of the cam clamp.

A modified hand tool with the fixed jaw and movable jaw facing in opposite directions, is best shown in FIG. 14. In this tool, the movable jaw 312 and the fixed jaw 322 are positioned on opposite sides of the support assembly 318. A pin 365 extending outwardly from the slide bar 314 prevents removal of the bar from the support assembly 318.

In operation of this embodiment, when the clamping handle assembly 324 with the cam portion 340 is pivotally moved to achieve incremental advancement, the movable jaw 312 connected to the slide bar advances away from the fixed jaw 322. If it is desired that the workpiece is to be spread apart by the movable and fixed jaws, the movable jaw is advanced away from the fixed jaw manually or by the action of the clamping handle assembly 324 activating the driving lever 332.

What is claimed:

1. A hand tool comprising:

a movable jaw;

a stationary jaw;

a slide bar, said movable jaw being mounted to said slide bar;

support means for supporting said slide bar; said stationary jaw being spaced away from said support means and having at least a front portion;

one-way drive means for releasably engaging and, when engaged, for advancing said slide bar and said movable jaw to an advance position and holding said movable jaw in said advanced position, said one-way drive means having at least a driving lever; and cam means having a longitudinally extending handle, said cam means having an eccentric working surface, said cam means pivotably mounted at said support means and contacting said driving lever, said cam means gradually disengaging said driving lever when said one-way drive means is released from said slide bar, and said cam means gradually engaging said driving lever when said one-way drive means engages said slide bar;

whereby said eccentric working surface engages said driving lever during a substantial part of pivotal motion of said cam means.

2. A hand tool according to claim 1, wherein said driving lever is positioned substantially transverse to said slide bar when said one-way drive means is released from the slide bar.

3. A hand tool according to claim 1, wherein said driving lever is positioned at an angle to said slide bar when said one-way drive means engages the slide bar.

4. A hand tool according to claim 1 further comprising receiving means in said support means, a release tab pivotable at said receiving means and having an engaging portion adjacent to said slide bar extending outwardly from said support means and away from said handle means for releasably engaging said slide bar.

5. A hand tool according to claim 1, wherein a rotary motion of said cam means causes said driving lever to pivot about its one end.

6. A hand tool according to claim 5, wherein such rotary motion of the cam means places the driving lever at an angle to the slide bar preventing said slide bar and the movable jaw from moving away from the stationary jaw.

7. A hand tool comprising:

a movable jaw;

a slide bar, said movable jaw being mounted to said slide bar;

a stationary jaw;

support means for supporting said slide bar; said stationary jaw being spaced away from said support means and having at least a front portion;

one-way drive means for releasably engaging and, when engaged, for advancing said slide bar and said movable jaw to an advanced position and holding said movable jaw in said advanced position, said one-way drive means having at least a driving lever; and cam means having a longitudinally extending handle, said cam means pivotably mounted at said support means and contacting said driving lever, said cam means disengaging said driving lever when said one-way drive means is released from said slide bar, and said cam means engaging said driving lever when said one way drive means engages said slide bar;

said cam means further comprising a handle unit and an engaging portion positioned at one end of said handle unit, said engaging portion having a cam-shaped portion and an elongated finger, wherein said cam-shaped portion and the elongated finger are separated by a recess.

8. A hand tool according to claim 7, wherein said driving lever is positioned substantially transverse to said slide bar when said one-way drive means is released from the slide bar.

9. A hand tool according to claim 7, wherein said driving lever is positioned at an angle to said slide bar when said one-way drive means engages the slide bar.

10. A hand tool according to claim 7 further comprising receiving means in said support means, a release tab pivotable at said receiving means and having an engaging portion adjacent to said slide bar extending outwardly from said support means and away from said handle means for releasably engaging said slide bar.

11. A hand tool according to claim 7, wherein a rotary motion of said cam means causes said driving lever to pivot about its one end.

12. A hand tool according to claim 11, wherein such rotary motion of the cam means places the driving lever at an angle to the slide bar preventing said slide bar and the movable jaw from moving away from the stationary jaw.

* * * * *